US008408527B2

(12) United States Patent
Klingenberg et al.

(10) Patent No.: US 8,408,527 B2
(45) Date of Patent: Apr. 2, 2013

(54) MULTIPLE JAW VISE AND METHOD OF MAKING THE SAME

(75) Inventors: James C. Klingenberg, Concord, OH (US); Harry P. Fuller, Newbury, OH (US)

(73) Assignee: Jergens, Inc., Cleveland, OH (US)

( * ) Notice: Subject to any disclaimer, the term of this patent is extended or adjusted under 35 U.S.C. 154(b) by 532 days.

(21) Appl. No.: 12/615,301

(22) Filed: Nov. 10, 2009

(65) Prior Publication Data

US 2010/0117283 A1 May 13, 2010

Related U.S. Application Data

(60) Provisional application No. 61/112,859, filed on Nov. 10, 2008.

(51) Int. Cl.
*B25B 1/20* (2006.01)
*B25B 1/00* (2006.01)

(52) U.S. Cl. ..... 269/154; 269/43; 269/156; 269/45

(58) Field of Classification Search ..... 269/154, 269/156, 165, 166, 43, 45, 246
See application file for complete search history.

(56) References Cited

U.S. PATENT DOCUMENTS 4,413,818 A * 11/1983 Lenz ..... 269/81
5,098,073 A * 3/1992 Lenz ..... 269/43
5,163,662 A * 11/1992 Bernstein ..... 269/136
5,623,757 A * 4/1997 Durfee, Jr. ..... 29/559
5,649,694 A * 7/1997 Buck ..... 269/43
5,735,513 A * 4/1998 Toffolon ..... 269/43
5,893,551 A * 4/1999 Cousins et al. ..... 269/43
6,079,704 A 6/2000 Buck
6,139,001 A 10/2000 Buck
6,217,014 B1 * 4/2001 Wolfe ..... 269/43
7,163,201 B2 * 1/2007 Bernstein ..... 269/32
7,434,775 B2 * 10/2008 Wilcox ..... 248/228.1
D640,521 S * 6/2011 Tschida et al. ..... D8/74

OTHER PUBLICATIONS

Jergens Vise Catalog, Jergens, Inc., Cleveland, Ohio, 2008, pp. 1-25.

* cited by examiner

*Primary Examiner* — Monica Carter
*Assistant Examiner* — Seahee Yoon
(74) *Attorney, Agent, or Firm* — Rankin, Hill & Clark LLP

(57) ABSTRACT

A two jaw vise having a base extending in a longitudinal direction between two ends, a central fixed block and opposing jaws on either side of the central block. The opposing jaws being movable longitudinally and joined to the base for controlled movement longitudinally. The base including a base block extending longitudinally between the first and second ends and including first and second longitudinally extending rails. The first and second rails extending parallel to the base block and being spaced from the base block. The first and second rails at least partially forming the controlled movement of the jaws. The base further including first and second pluralities of vertically extending columns extending between the base block and the first and second rails, respectively. The base including at least one gap between adjacent columns.

18 Claims, 9 Drawing Sheets

MULTIPLE JAW VISE AND METHOD OF MAKING THE SAME

This application claims priority in Provisional Patent Application Ser. No. 61/112,859 filed on Nov. 10, 2008 which is incorporated by reference herein in its entirety.

The invention of this application relates to vises and, more particularly, to multiple jaw vises.

INCORPORATION BY REFERENCE

The invention of this application relates to vises and, more particularly, to multiple jaw vises wherein multiple jaw vises are known in the art. In particular, Buck U.S. Pat. No. 5,649,694 discloses a multiple jaw vise and is incorporated by reference herein for showing the same. Similarly, Buck U.S. Pat. No. 6,079,704 discloses a multiple jaw vise and is incorporated by reference herein for showing the same. Buck U.S. Pat. No. 6,139,001 discloses a multiple jaw vise and is incorporated by reference herein for showing the same. Cousins et al. U.S. Pat. No. 5,893,551 discloses a multiple jaw vise with machinable jaws and is incorporated by reference herein for showing the same. Lenz U.S. Pat. No. 5,098,073 discloses a multiple jaw vise with a double threaded screw and is incorporated by reference herein for showing the same. Also incorporated by reference herein in its entirety is JERGENS Production Vise Catalog which is attached and forms part of this specification as does the above incorporation by reference documents.

BACKGROUND OF THE INVENTION

Vises are well known in the art and have evolved over the years. Further, multiple jaw vises are also known in the art and have been well received. In particular, the vises shown in the Buck patents listed above and incorporated by reference in this application as background material have been well received. These patents disclose two jaw vises that are effective and which have been used in industry for many years. However, the vises shown in the Buck patents are costly to manufacture and are costly and difficult to maintain in the field. One such difficulty in the field is that the chips produced by an associated machining operation can become lodged in the vise's actuation mechanism and can be difficult to remove from portions of the vise. This can cause considerable down time for a machining operation which can be costly. This is especially true in view of the costs associated with operating the machines in which these kinds of vises are used. Further, these costs include both machine cost for the machine being idle during this cleaning work and the labor cost associated with the operator working on non-productive work during this cleaning operation. As is known in the art, both the machining time and operator time for these kinds of machining operations are costly. Further, having one of these operations down to allow for the chip removal or cleaning of the vise also impacts the operation's production numbers.

With special reference to FIG. 3 of Buck U.S. Pat. No. 6,139,001, shown is an end sectional view of Buck's vise or work holding device 11 with a base member 12. Also shown is right movable jaw assembly 16. Jaw assembly 16 is one of the two jaws disclosed in Buck. Particular reference is taken to base member 12 which is a solid block of material wherein a central guide passage or channel 26 must be machined to form this base. More particularly, base member 12, after machining, has upwardly projecting side legs 20, 22 extending on either side of central passage 26. This longitudinally extending guide passage 26 has a generally inverted T-shaped cross-sectional configuration wherein it has an upward opening between the parallel side legs 20, 22 that is smaller than the bottom region of this passage. This guide passage is defined in part by opposed guide surfaces 28, 30 which define opposite sides of the upper portion of guide passage 26. The bottom portion of guide passage 26 is partially defined by a bottom guide surface 32 that is wider than the spacing between surfaces 28 & 30 which forms this "T" shape. As can be appreciated, passage 26 requires one or more expensive machining operations to transform a solid block of material into the disclosed T-shaped block. While other manufacturing methods could be used, each would require expensive tooling and/or machinery to produce the base. Yet even further, this method of machining block 12 makes producing multiple sizes of these vises difficult and expensive.

SUMMARY OF THE INVENTION

The invention of this application relates to vises and more particularly to multiple jaw vises that are more cost effective to produce and which are less costly to operate. More particularly, the vise according to the present invention includes a multi-piece base section that reduces the number of machining operations necessary to produce the vise.

According to one aspect of the invention of this application, the base member is formed by a lower member and an upper member joined by vertically extending supports.

According to another aspect of the invention of this application, the vertical members are a plurality of spaced cylindrical members extending along the side edge of the upper and lower base members.

According to yet a further embodiment of the invention of this application, the base is formed by a bottom block having a generally rectangular cross-sectional configuration with two ends and opposing sides extending between these ends. This base further includes vertically extending support columns positioned along both of these opposing sides in a spaced relationship joining the bottom block to a pair of parallel top blocks extending with the bottom block with are spaced from one another thereby forming a central slot for guiding the jaws of the vise.

BRIEF DESCRIPTION OF THE DRAWINGS

The foregoing, and more, will in part be obvious and in part be pointed out more fully hereinafter in conjunction with a written description of preferred embodiments of the present invention illustrated in the accompanying drawings in which.

DETAILED DESCRIPTION OF EMBODIMENTS

Figure 1:
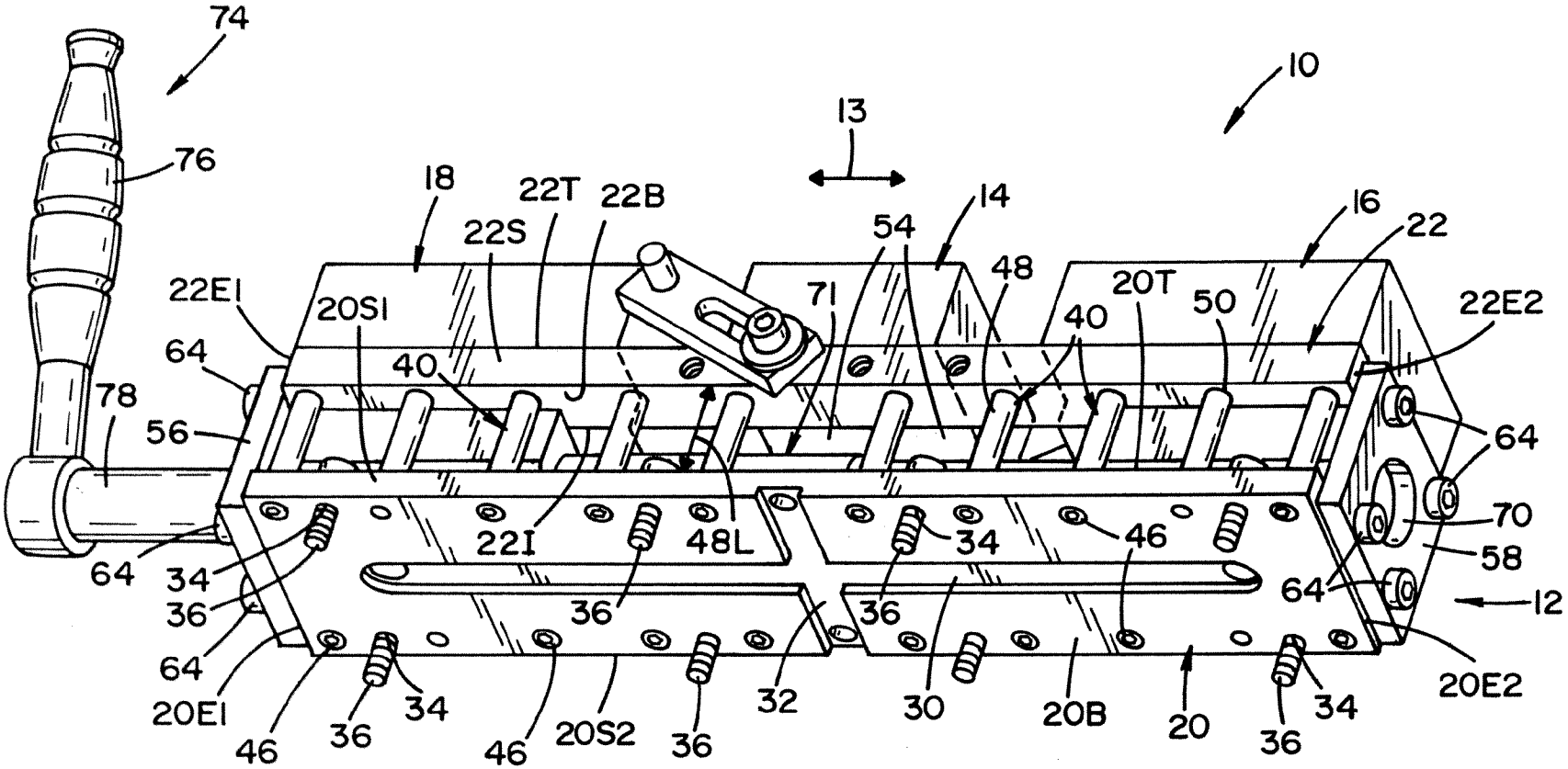
FIG. 1 is a bottom perspective view of a vise according to certain aspects of the present invention.
Figure 2:
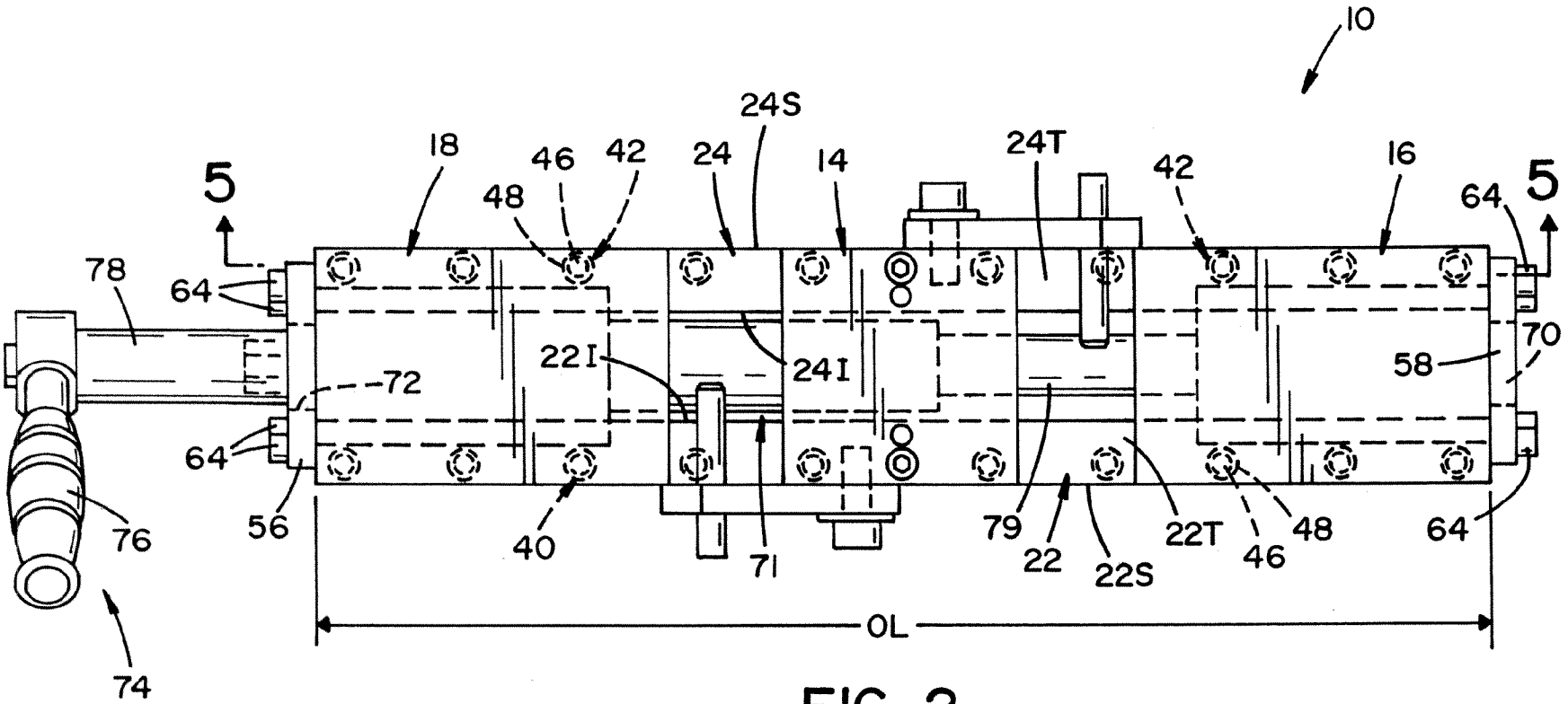
FIG. 2 is a top view of the vise shown in FIG. 1.
Figure 3:
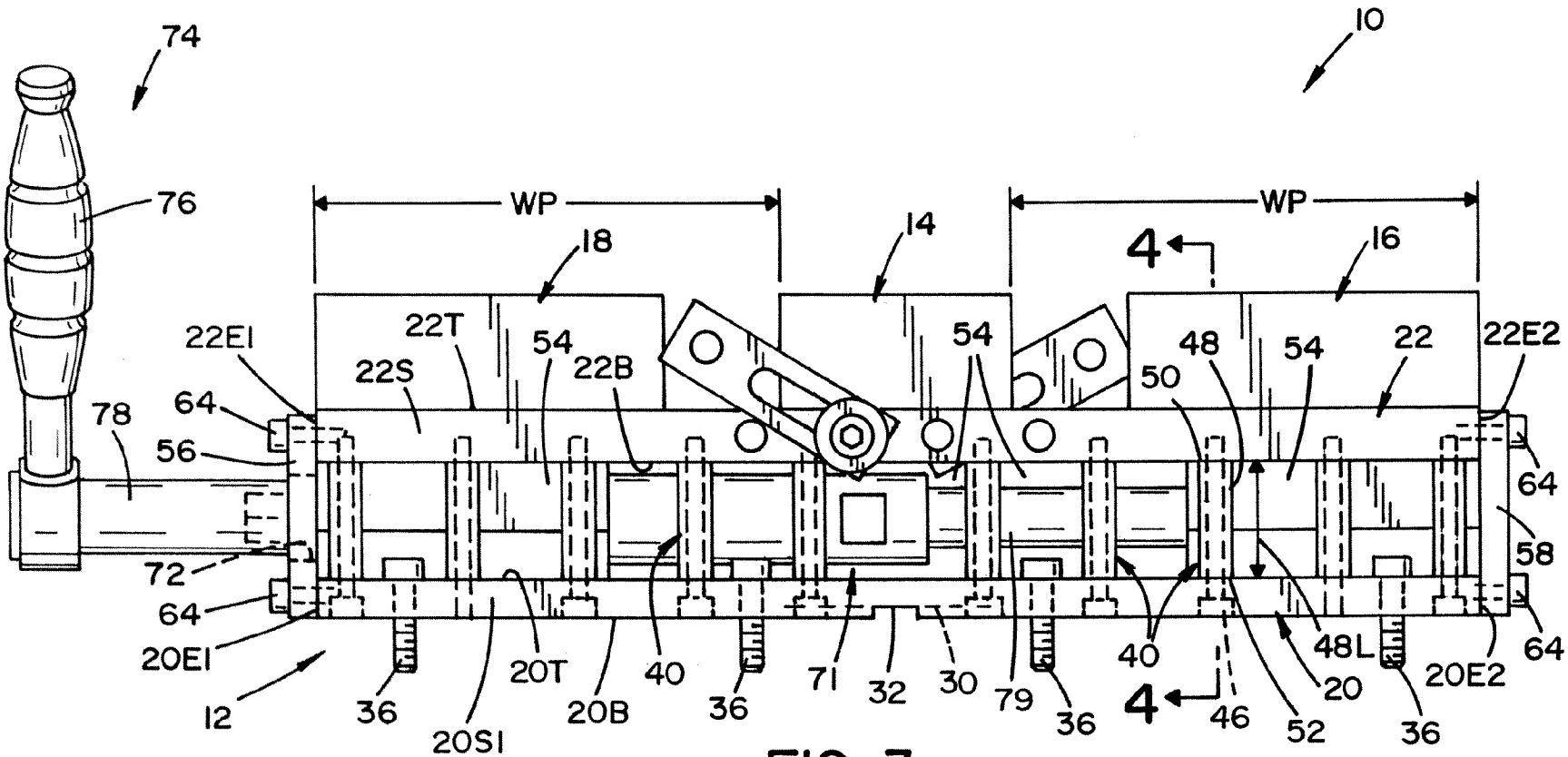
FIG. 3 is a side view of the vise shown in FIG. 1.
Figure 4:
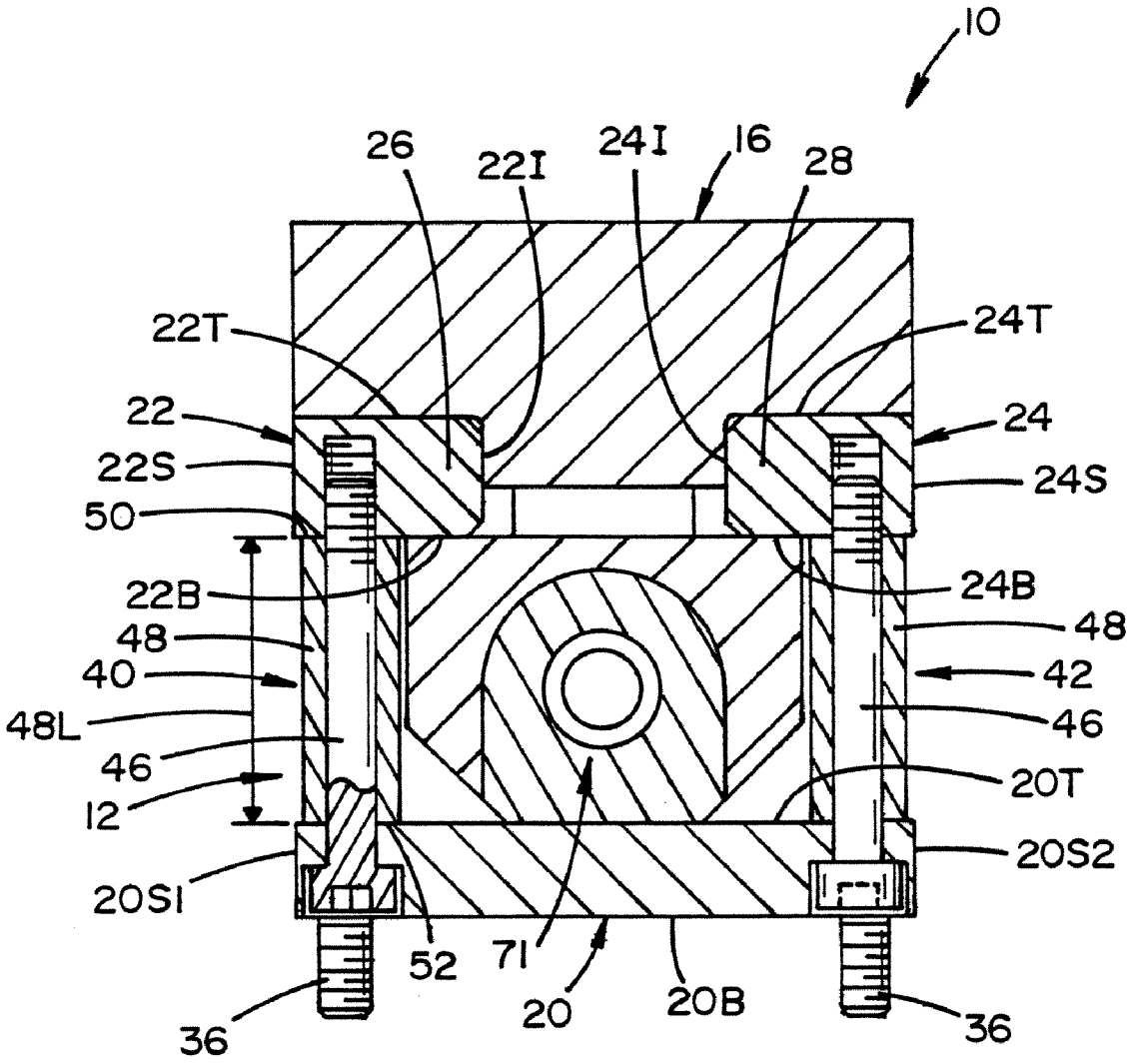
FIG. 4 is a sectional view taken along lines 4-4 in FIG. 3.
Figure 5:
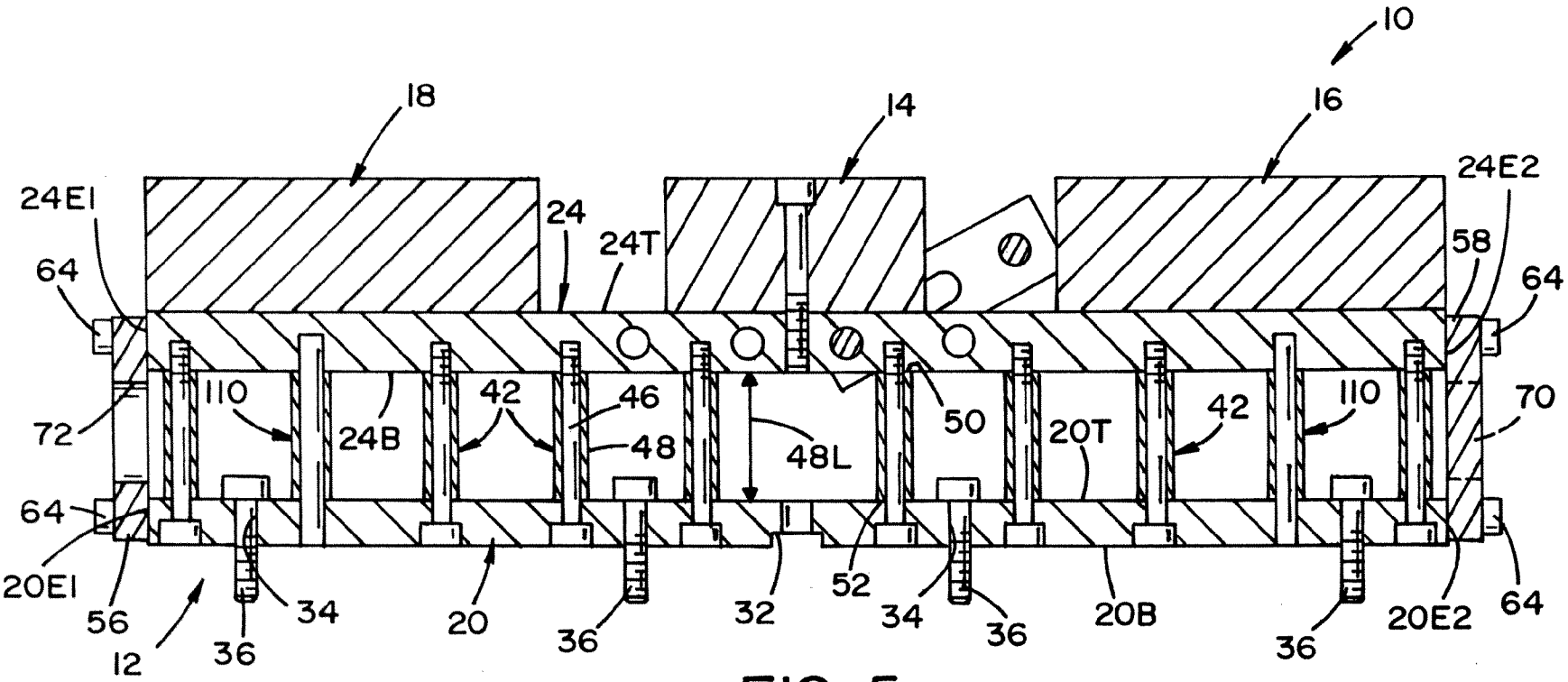
FIG. 5 is a sectional view taken along lines 5-5 in FIG. 2.

Referring now to the drawings, in view of the background material of this application, and with special reference to FIGS. 1-5, shown is a two jaw vise 10 which generally includes a base 12, a central jaw block 14 and a pair of opposing vise jaws 16 and 18. As is known in the art, jaws 16 and 18 move relative to base 12 toward and away from one another and function to clamp one or two work pieces (not shown) between the respective vise jaws and central block 14. The movement of these jaws is in a working portion WP of the vise. Details on this vise and jaw arrangement are not described herein in the interest of brevity in that it is well known in the art and is shown and described in the Buck patents incorporated by reference in this application and which form a part of this description.

Base 12 has an overall length OL extending in a longitudinal direction 13 and is a multi-component base as opposed to the machined solid block found in the prior art. In this respect, base 12 includes a bottom or base block 20 that can be a single solid block, multiple components joined together, a non-solid block and variations thereof. In that it has been found that a single unified component block works particularly well, this single block arrangement is shown while this application is not to be limited to a single component bottom block. Bottom block 20 further includes a top surface 20T and an oppositely facing bottom surface 20B with ends 20E1 and 20E2, and sides 20S1 and 20S2. Further, block 20 can be substantially rectangular across a major portion of length OL or at least along portions WP.

Base 12 further includes upper rails 22 and 24 that extend parallel to one another in a longitudinal direction 13. As with bottom block 20, rails 22 and 24 can be formed by any method known in the art including, but not limited to, a machined rail and an extruded rail. Further, these rails can be a single component as is shown or formed by multiple components, such as multiple rail sections, to form the needed profiles to allow controlled motion of the jaws as is needed to produce a vise that can effectively hold a work piece. In one embodiment, rails 22 and 24 are rectangular rails such that rail 22 includes a top 22T, a bottom 22B, an inner edge 221 and an outer side edge 22S; similarly, rail 24 can include a top 24T, a bottom 24B, an inner edge 241 and an outer side edge 24S. Rails 22 and 24 further include ends 22E1 and 22E2; and 24E1 and 24E2, respectively. As with bottom 20, rails can be substantially rectangular across a major portion of length OL or at least along portions WP. Rail 22 and 24 can produce the controlled motion of the jaws by including inwardly facing portions 26 and 28. In other embodiments, the controlled motion of jaws 16 and 18 can be by both portions 26 and 28 and top 20T of block 20.

Further, the rails and/or blocks can also include any known feature in the art to help the vise mount onto and maintain its position relative to a machining operation. This can include, but is not limited to keyways 30 and 32 in block 20 and fastener openings 34 for alignment pins and/or securing bolts 36.

Base 12 further includes vertically extending columns 40 that extend between bottom block 20 and rail 22 and vertical extending columns 42 that extend between block 20 and rail 24. In this embodiment, columns 40 and 42 are mounted columns in that they are separate components mounted between the rails and the bottom block. Columns 40 and/or 42 can be any form of column like structure without detracting from the invention of this application. Further, all of columns 40 do not need to be identical and, similarly, all of columns 42 do not need to be identical. Further, some or all of columns 40 can be different than some or all of columns 42 and visa versa. In one embodiment, columns 40 and 42 are cylindrical columns which can be formed by a column bolt 46 and a sleeve 48 wherein sleeve 48 has a length 48L and a central passage which allows bolt 46 to pass therethrough. In this respect, sleeves 48 and/or columns 40/42 can extend between a top extent 50 and a bottom 52 extent wherein top 50 engages rail bottoms 22B and 24B and bottom 52 engage base top 20T, and define length 48L.

Sleeve 48 can be a wide range of configurations including the cylindrical configuration shown and length 48L can be used to maintain a desired spacing between the rails and the bottom block. Further, these columns could be a unified component or could include multiple fasteners. In yet even other embodiments, one or more columns could be spacers wherein dowels or other components hold them in place. But, these columns can be configured such that they do not include locking fasteners such as a bolt which will be discussed in greater detail below.

A plurality of columns 40 and/or 42 can be spaced longitudinally along the rails to produce side gaps 54 between adjacent columns which also will be discussed in greater detail below. In this particular embodiment, ten columns are used on each rail wherein there are a total of twenty columns. In other embodiments, some of which will be discussed in greater detail below, more or less columns could be used without detracting from the invention of this application.

Base 12 further includes end caps or plates 56 and 58 positioned on the longitudinal ends 20E1 and 20E2 of bottom 20, respectively. End cap 56 extends between rail ends 22E1 and 24E1 and bottom block end 20E1 wherein cap 56 also joins block 20 to rails 22 and 24 and maintains spacing 48L similar to that of columns 40 and 42. Similarly, end cap 58 extends between rail ends 22E2 and 24E2 and bottom block end 20E2 wherein cap 58 also joins block 20 to rails 22 and 24. End caps 56 and 58 can be joined to the rails and the bottom in any way known in the art including, but not limited to removable fasteners. In one embodiment, caps 56 and 58 are joined to the rails and the bottom by way of fasteners 64 which threadingly engage with the rails and the bottom. By using threaded fasteners, vise 10 can be disassembled to allow for cleaning and the repair of internal components. However, in other embodiments, and for certain industries, the vise may be designed to be tamperproof. As with all fasteners referenced in this application, any fastener known in the art can be used for fastener 64 and others.

End plates 56 and 58 can include any feature or configuration known in the art to allow the vise to operate in the field including opening 70 which can allow for access to a driving or actuation mechanism 71 of vise 10 and opening 72 which allows crank 74 to actuate the driving mechanism which will not be discussed in greater detail herein in the interest of brevity in that vise driving mechanisms are known in the art. Crank 74 can be any crank known in the art including a crank which includes a transverse handle 76 joined to a shaft 78. In addition, mechanism 71 can include an adjustable length shaft portion 79 to allow mechanism 71 to be used for more than one size vise which will be discussed in greater detail below.

Rails 22 and 24 can at least partially control the movement of jaws 16 and 18 to allow for their longitudinal movement. Further, this control can be supplemented by portions of the base block. As is shown, this control is assisted by base top 20T.

In the embodiments discussed below, like reference numbers are used to describe like or similar components of the vises described above and further discussions of these components is not being repeated in the interest of brevity.

Figure 6:
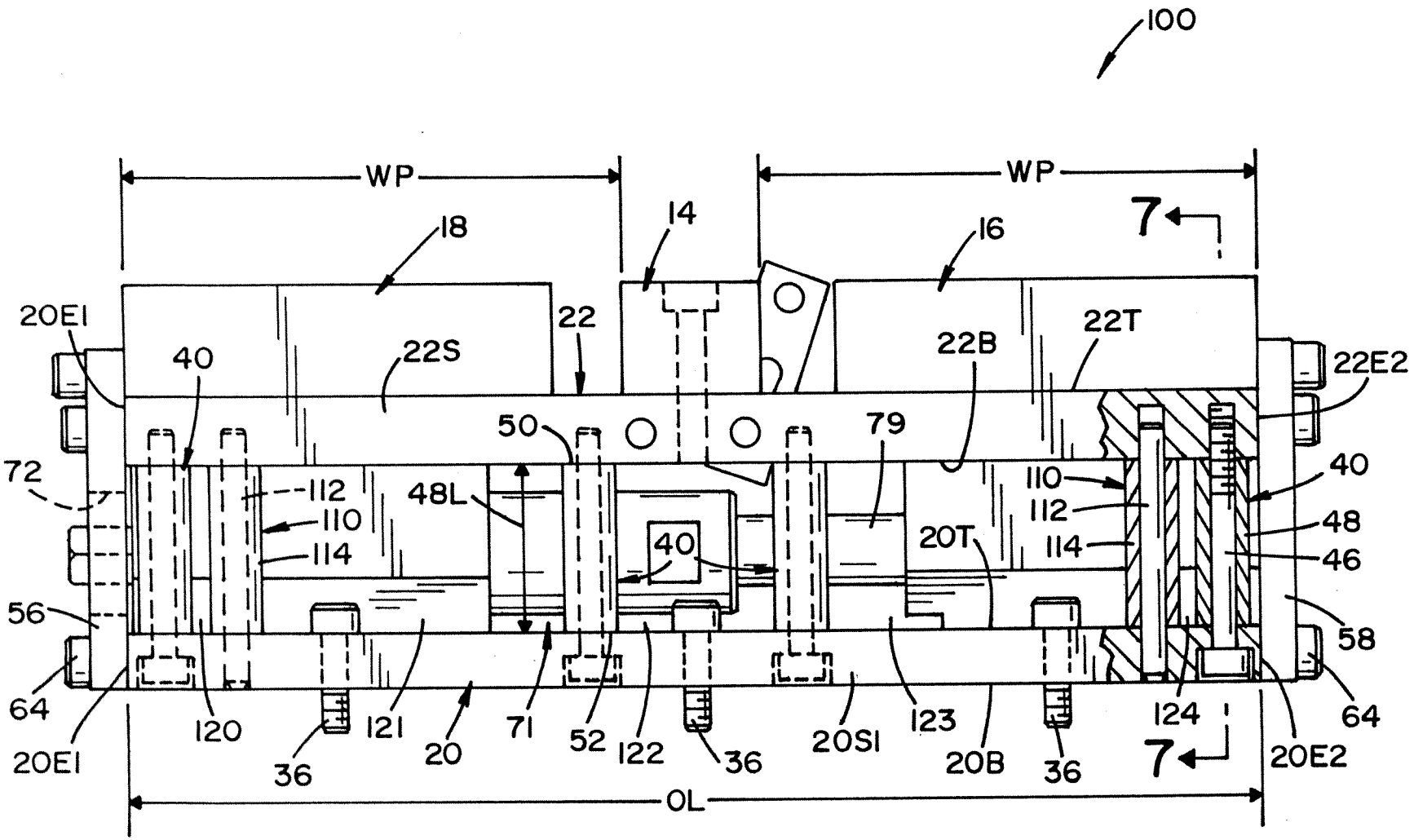
FIG. 6 is a side view of yet another embodiment according to certain aspects of the present invention.
Figure 7:
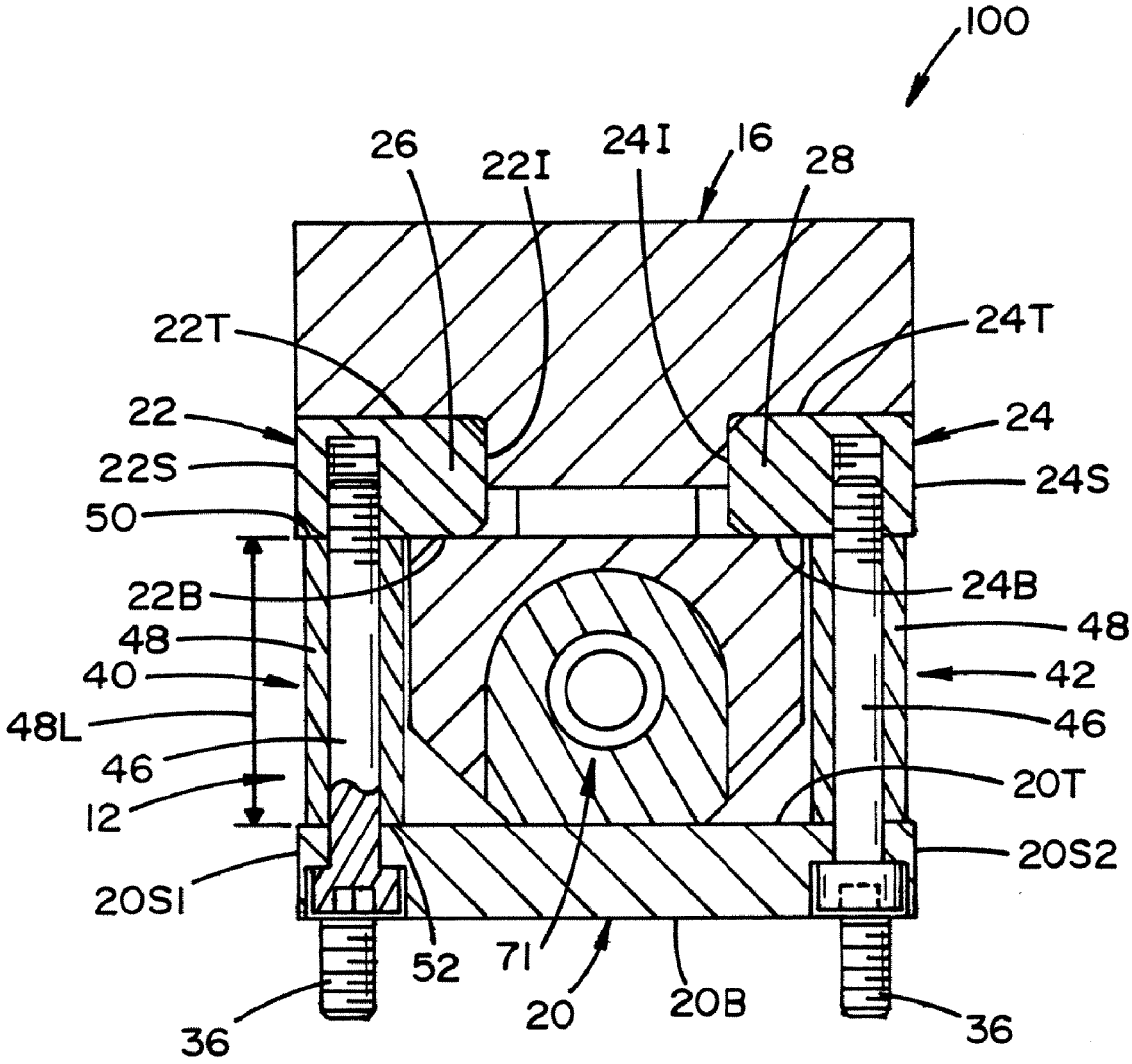
FIG. 7 is a sectional view taken along lines 7-7 in FIG. 6.

With reference to FIGS. 6 and 7, shown is vise 100 having an overall length OL and which includes yet other column arrangements. In these embodiments, vise 100 includes both a different number of columns and more than one configuration of column. More particularly, vise 100 includes columns 110 having an inner pin 112 and a sleeve 114. However, while shown as two component columns, these columns and other columns can be formed by a single component without detracting from the invention of this application.

In one embodiment, vise 100 includes two columns 110 and four columns 40 extending between rail 22 and bottom 20. While, in this embodiment, columns 40 can be used to secure or fasten the rail to the bottom and columns 110 can be used to merely maintain a desired spacing 48L, columns 110 could be press fitted into the rail and the bottom to also fasten the two components together at least in part. As is discussed above, this could be used to help make the vise tamperproof. Further, other joining methods could be used, such as welding, to join the columns to the bottom and rails. Similarly, the same column arrangement can be used to secure rail 24 to bottom 20. However, as is mentioned above, while it may be preferred to make both sides the same, this is not necessary and this application should not be limited in that way. Further, this particular column arrangement, including the specific location and columns 110 relative to columns 40, is not required and this application should not be limited to this specific spacing and/or locations.

As with the other embodiments of this application, spacings or gaps are produced in these side portions of the vise. In the embodiments shown in FIGS. 6 and 7, gaps of different sizes are produced. In this respect, vise 100 includes gaps 120-124 which have differing sizes. Gaps 121 and 123 are in working portions WP, which are closer to the machining locations of the vise. These gaps can be larger to allow for the chips to be cleaned more easily from these working regions. While not shown in the interest of brevity, the opposite side of vise 100 can include the same column configuration; however, this is not a requirement.

Figure 8:
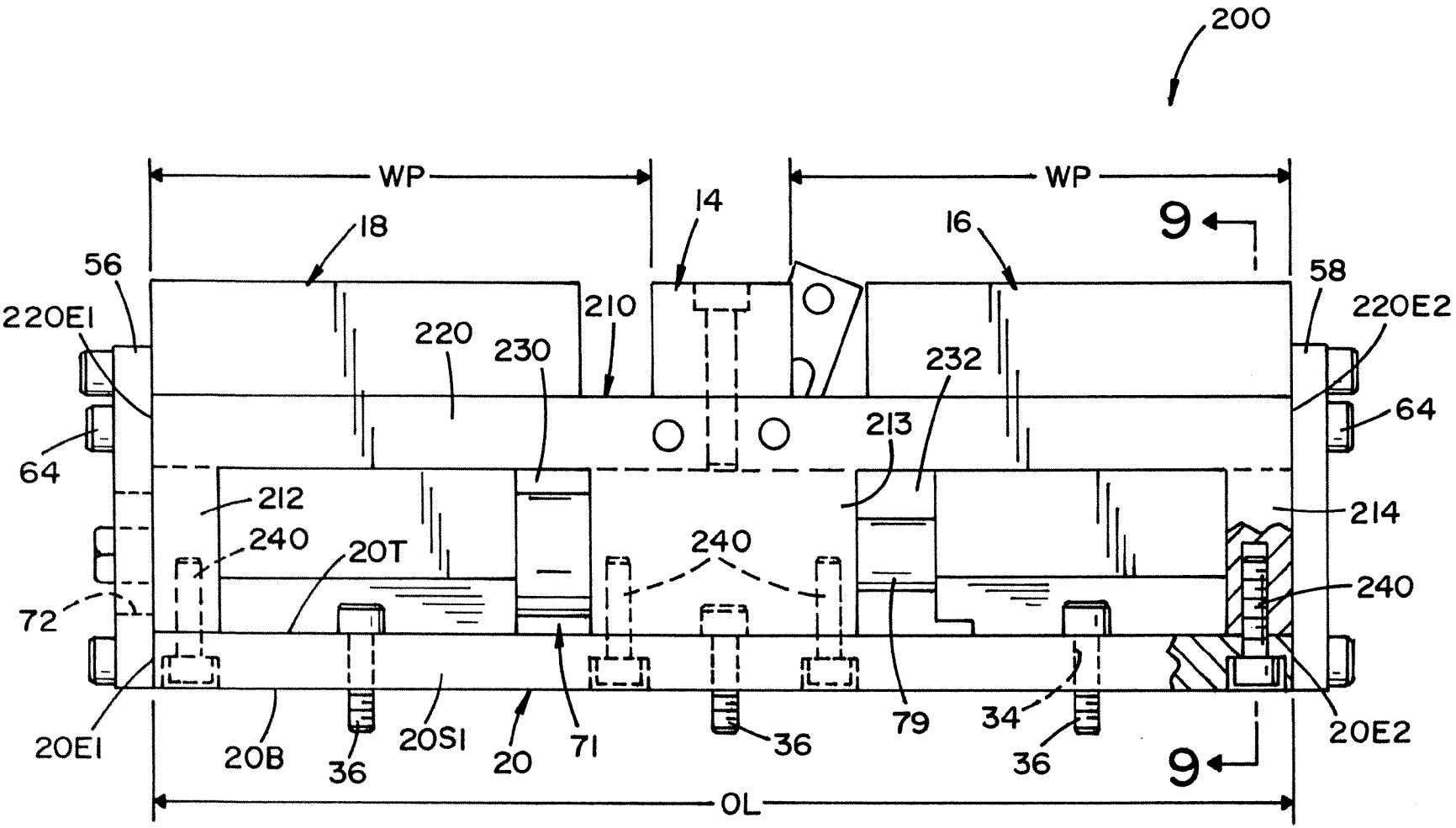
FIG. 8 is a side view of yet a further embodiment according to certain aspects of the present invention.
Figure 9:
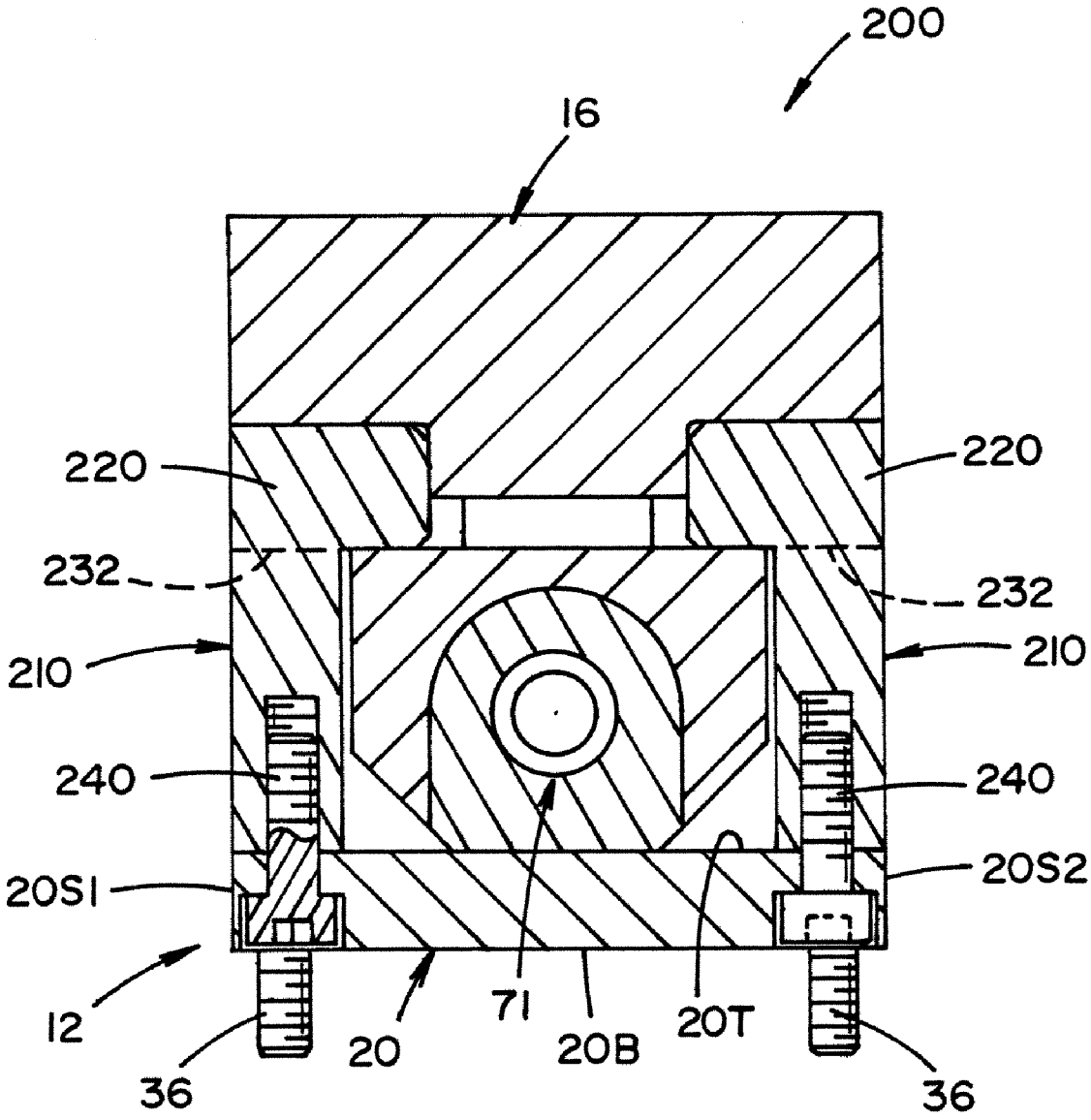
FIG. 9 is a sectional view taken along lines 9-9 in FIG. 8

With reference to FIGS. 8 and 9, shown is vise 200 that includes yet other embodiments. In this respect, vise 200 includes side rails wherein at least a portion of the rails extending to bottom 20 thereby having an integral column arrangement. In this respect, vise 200, which has an overall length OL, includes a rail 210 having downwardly extending columns 212-214 which extend downwardly from a top rail portion 220. Rail 210 has a length OL and extends between ends 220E1 and 220E2. In this embodiment, the columns are an integral component of the rail portion or could be fabricated to the rail portion by any joining method known in the art including, but not limited to, welding. In that columns 212-214 are spaced from one another, rail 210 includes spacings or gaps 230 and 232 in working portions WP. Further, while vise 200 is shown to include columns having different widths in the longitudinal direction, this is not required and rail 210 could be formed by columns having uniform widths and/or equal spacings or gaps therebetween. The same is true with the size of the gaps. These do not need to be identical and there could be any number of these spacings depending on the size of the vise. Further, in yet other embodiments, the vise can include a combination of integral columns and mounted columns. Rail 210 can be joined to base 20 by fasteners 240 that pass through bottom 20 and thread into one of columns 212-214.

As a result of this construction, base 12 can be formed without the need to perform multiple and deep grinding operations to a solid metal block. Further, these grinding operations can be dimensionally critical wherein precision grinding equipment along with special grinding wheels can be necessary. As can be appreciated, these grinding wheel operations can also require costly wheel dressing operations to achieve the necessary internal dimensions and/or profiles of this machined block. While this can be simplified by using computer control grinding and/or milling operations (CNC), the amount of material that needs to be removed can use a considerable amount of machining time which is also costly.

As can also be appreciated, not only is it expensive to perform multiple machining operations to the base block, a considerable amount of waste is also produced by these machining operations. In this respect, the machining necessary to produce prior art bases can result in a significant amount of scrap metal in that much of the block is machined away. While metal chips can be salvaged, this is wasteful especially in view of the costly metal that is often used to produce these bases and the energy costs associated with this amount of machining. In the embodiments of the invention of this application, significant amounts of scrap and energy can be eliminated in that the bottom, rails and end caps can be purchased such that they are configured similar to their final dimensions and relatively simple machining operations can produce parts within the desired dimensional tolerances.

Furthermore, this base configuration also advantageously produces the openings, spacings or gaps 54, 120-124, 230 and/or 232 spaced about the sides of the base that allow the chips, produced during an associated machining operation using vise 10, 100 and 200, to be easily blown out of these bases. As can be appreciated, when these vises are in use a considerable amount of chips can often be produced as the component part, that is being held by the vises are being machined. These chips need to be cleaned from the vise or the vise could eventually jam which can cause down time for the particular machining operation.

Again, as is discussed above, the vises of this application can have any actuation mechanism known in the art including, but not limited to, manually cranked vises and hydraulic vises.

In even yet other embodiments, combinations and equivalences thereof of the components including, but not limited to, the column arrangements can be used to produce even more vises according to the invention of this application.

Yet another benefit of the vise of this application is the ability to quickly and easily produce a wide range of sizes of these vises. As is known in the art, virtually any item can be machined to produce a finished part or component. In that virtually any component can be machined, there is a need for vises in a wide range of sizes. This situation is difficult for the vise manufacturing of prior art vises in that each component must be machined differently for each size. As a result, it is difficult and costly to stock multiple sizes of vise bases and it is then difficult to fill vise orders quickly in that unique components must be manufactured or inventoried to produce each vise.

However, a vise according to the present invention can be quickly made to order in view of the ability to stock common components to produce a much wider range of vise sizes. In this respect, the primary components of the vises of this application can be quickly formed into a vise of a desired size without the need for high cost inventory. For example, the rails and the bottom blocks discussed above are much less costly to produce than the prior art machined base in that they can be extruded and/or require much less costly machining operations. This alone greatly reduces inventory costs. In addition to this benefit, these less costly parts can be made in lengths much longer than overall length OL of each vise. Then, once an order arrives, these components can be quickly cut or trimmed to the desired overall length of the particular vise. This can be a relatively simple trimming operation in that the overall length dimension does not require the tight tolerances of the internal machining operation of the prior art vises. Further, multiple lengths of the actuating shafts and/or adjustable shaft sections 79 of the vise can also be utilized to allow for these differing lengths. As a result, different size vises can be quickly made with common components and these common components can be inventoried at much lower costs than was possible with prior art vises. This can further include stocking a single base for different widths of vises wherein a relatively simple trimming operation could also be used to transform a universal base block into more than one size vise.

While not shown, the vise according to the present invention can be used for any known application, and even newly found applications, for these styles of vises. This includes powered versions of these vises wherein hand crank 74 is replaced with a powered crank (not shown). Further, the vise according to the present invention could be incorporated as a component of a clamping system without detracting from the invention of this application.

While considerable emphasis has been placed on the preferred embodiments of the invention illustrated and described herein, it will be appreciated that other embodiments and/or equivalents thereof can be made and that many changes can be made in the preferred embodiments without departing from the principles of the invention. Accordingly, it is to be distinctly understood that the foregoing descriptive matter is to be interpreted merely as illustrative of the invention and not as a limitation.

It is claimed:

1. A two jaw vise for fixedly holding one or more associated work pieces for an associated operation, said vise comprising a base extending in a longitudinal direction between a first end and a second end, said vise further including a central fixed block between said first and second ends and which is fixable relative to said base, said vise further including two opposing and moving jaws on either side of said central block, said opposing jaws being movable in said longitudinal direction toward and away from said central block by an actuation mechanism also extending in said longitudinal direction, said opposing jaws being joined to said base for controlled movement in said longitudinal direction between a respective end of said vise and said central block, said base including a base block extending in said longitudinal direction between said first and second ends, said base further including first and second longitudinally extending rails extending between said first and second ends, said first and second rails extending parallel to said base block and being spaced from said base block, said first and second rails at least partially forming said controlled movement of said opposing jaws, said base further including a first plurality of vertically extending columns that are separate components and joinable to said base block, said first plurality of vertically extending columns extending transverse to said longitudinal direction between said base block and said first rail and a second plurality of vertically extending columns that are separate components and joinable to said base block, said second plurality of vertically extending columns extending transversely between said base block and said second rail, said first and second plurality of vertically extending columns at least partially forming said spacing between said first and second longitudinally extending rails and said base, said base including at least one gap between at least one pair of adjacent columns.

2. The vise of claim 1, further including a first end cap and a second end cap, said first end cap positioned on said first end and joining said rails to said base and said second end cap positioned on said second end and joining said rails to said base.

3. The vise of claim 2, wherein said base block includes a top extent and at least one of said first and second end caps includes a crank opening for said actuation mechanism, said crank opening being position higher than said top extent.

4. The vise of claim 1, wherein said at least one gap is a plurality of gaps and said plurality of gaps are generally equal in said longitudinal and transverse directions.

5. The vise of claim 1, wherein said first and second plurality of vertically extending columns have cylindrical cross-sectional configurations.

6. The vise of claim 5, wherein said first and second plurality of vertically extending columns are formed by a threaded fastener and a cylindrical sleeve.

7. The vise of claim 1, wherein said first and second plurality of vertically extending columns are formed by a threaded fastener and a sleeve.

8. The vise of claim 1, wherein said base block has a rectangular cross-sectional configuration and includes a top side facing said jaws and an oppositely facing bottom side, said first and second plurality of vertically extending columns engaging said top side.

9. The vise of claim 8, wherein said at least one gap is a plurality of gaps and said base block further including a plurality of mounting holes for securing said vise to an associated machining operation, each of said plurality of mounting holes being positioned near one of said plurality of gaps.

10. The vise of claim 9, wherein said bottom side of said base block includes at least one keyway.

11. The vise of claim 1, wherein said first and second rails have a generally rectangular cross-sectional configuration and each having an inwardly facing portion facing one another, said inwardly facing portion at least partially producing said controlled movement.

12. The vise of claim 1, wherein said base block has a rectangular cross-sectional configuration having a top side facing said rails, said rails having bottom sides and said first and second plurality of vertically extending columns engaging said top side of said bottom block and said bottom sides of said rails.

13. The vise of claim 1, wherein said first rail is a unified component and said second rail is a unified component both extending between said ends.

14. The vise of claim 1, wherein said at least one gap is a plurality of gaps and said plurality of gaps are not identical in size.

15. A two jaw vise for fixedly holding one or more associated work pieces for an associated operation, said vise comprising a base extending in a longitudinal direction between a first end and a second end, said vise further including a central fixed block between said first and second ends and which is fixable relative to said base, said vise further including two opposing and moving jaws on either side of said central block, said opposing jaws being movable in said longitudinal direction toward and away from said central block by an actuation mechanism also extending in said longitudinal direction, said opposing jaws being joined to said base for controlled movement in said longitudinal direction between a respective end of said vise and said central block, said base including a base block having a generally planar configuration with a top surface and an opposing bottom surface, said base block extending in said longitudinal direction between said first and second ends, said base further including first and second longitudinally extending rails extending between said first and second ends, said first and second rails extending parallel to said base block and being spaced from said top surface of said base block, said first and second rails at least partially forming said controlled movement of said opposing jaws, said base further including a first plurality of vertically extending columns that are separate components and extend transverse to said longitudinal direction between said top surface of said base block and said first rail and a second plurality of vertically extending columns that are separate components and extend transversely between said top surface of said base block and said second rail, said base including at least one gap between at least one pair of adjacent columns.

16. A two jaw vise for fixedly holding one or more associated work pieces for an associated operation, said vise comprising a base extending in a longitudinal direction between a first end and a second end, said vise further including a central fixed block between said first and second ends and which is fixable relative to said base, said vise further including two opposing and moving jaws on either side of said central block, said opposing jaws being movable in said longitudinal direction toward and away from said central block by an actuation mechanism joined to a crank and said actuation mechanism extending in said longitudinal direction, said opposing jaws being joined to said base for controlled movement in said longitudinal direction between a respective end of said vise and said central block, said base including a base block extending in said longitudinal direction between said first and second ends, said base block having a generally planar top surface and said generally planar top surface being lower than said actuation mechanism, said base further including a longitudinally extending rail extending between said first and second ends, said longitudinally extending rail extending parallel to said base block and being spaced from said planar top surface of said base block, said longitudinally extending rail at least partially forming said controlled movement of said opposing jaws, said base further including a plurality of vertically extending columns that are separate components and extend transverse to said longitudinal direction between said top planar surface of said base block and said longitudinally extending rail and said plurality of columns being fastenable to said base block, said base including gaps between adjacent columns.

17. A two jaw vise for fixedly holding one or more associated work pieces for an associated operation, said vise comprising a base extending in a longitudinal direction between a first end and a second end, said vise further including a central fixed block between said first and second ends and which is fixable relative to said base, said vise further including two opposing and moving jaws on either side of said central block, said opposing jaws being movable in said longitudinal direction toward and away from said central block by an actuation mechanism also extending in said longitudinal direction, said opposing jaws being joined to said base for controlled movement in said longitudinal direction between a respective end of said vise and said central block, said base including a base block extending in said longitudinal direction between said first and second ends, said base block having a generally rectangular cross-sectional configuration between said first and second ends with a upwardly facing surface and a downwardly facing surface opposite of said upwardly facing surface, said base further including first and second longitudinally extending rails extending between said first and second ends, said first and second rails extending parallel to said base block and being spaced from said upwardly facing surface of said base block, said first and second rails at least partially forming said controlled movement of said opposing jaws, said base further including a first plurality of vertically extending columns that are separate components and are joinable to the base block, said first plurality of columns extending transverse to said longitudinal direction between said upwardly facing surface of said base block and said first rail and a second plurality of vertically extending columns that are separate components and are joinable to the base block, said second plurality of columns extending transversely between said upwardly facing surface of said base block and said second rail, said base including at least one gap between at least one pair of adjacent columns and between said upwardly facing surface of and one of said first and second rails.

18. The vise of claim 17, wherein said downwardly facing surface includes in at least one tooling groove.

* * * * *